US008317051B2

(12) United States Patent
Jin et al.

(10) Patent No.: US 8,317,051 B2
(45) Date of Patent: Nov. 27, 2012

(54) TRASH CAN LID

(75) Inventors: Jiaming Jin, Zhejiang (CN); Xiaofeng Lu, Zhejiang (CN); Zhongjun Zhou, Zhejiang (CN)

(73) Assignee: Zhejiang Jiaxing Zhongda Group Co., Ltd., Baibu Town, Haiyan, Zhejiang (CN)

( * ) Notice: Subject to any disclaimer, the term of this patent is extended or adjusted under 35 U.S.C. 154(b) by 252 days.

(21) Appl. No.: 12/795,662

(22) Filed: Jun. 8, 2010

(65) Prior Publication Data

US 2011/0139781 A1 Jun. 16, 2011

(30) Foreign Application Priority Data

Dec. 10, 2009 (CN) ..... 2009 2 0291683 U

(51) Int. Cl.
*B65D 43/26* (2006.01)
*B65D 43/16* (2006.01)

(52) U.S. Cl. ..... 220/254.5; 220/254.6; 220/263; 220/315; 220/230

(58) Field of Classification Search ..... 220/254.5, 220/254.1, 254.3, 254.6, 254.7, 254.9, 908, 220/260, 263, 262, 264, 230, 315, 833, 834, 220/835

See application file for complete search history.

(56) References Cited

U.S. PATENT DOCUMENTS

| | | | | |
|---|---|---|---|---|
| 1,126,640 | A * | 1/1915 | Jones | 220/254.3 |
| 4,456,141 | A * | 6/1984 | Pamment | 220/254.5 |
| 5,385,259 | A * | 1/1995 | Bernstein et al. | 220/495.11 |
| 6,345,725 | B1 * | 2/2002 | Lin | 220/263 |
| 6,626,291 | B2 * | 9/2003 | Pozzoli | 206/308.1 |
| 6,857,538 | B2 * | 2/2005 | Lin | 220/830 |
| RE39,726 | E * | 7/2007 | Lin | 220/263 |
| 7,243,816 | B2 * | 7/2007 | Aochi | 220/829 |
| 7,543,716 | B2 * | 6/2009 | Lin | 220/495.11 |
| 7,770,749 | B2 * | 8/2010 | Lin | 220/254.5 |
| 2003/0201265 | A1 * | 10/2003 | Lin | 220/254.3 |
| 2005/0139598 | A1 * | 6/2005 | Tack et al. | 220/259.1 |
| 2010/0006572 | A1 * | 1/2010 | Chiou | 220/263 |

* cited by examiner

*Primary Examiner* — Steven A. Reynolds
(74) *Attorney, Agent, or Firm* — Global IP Services; Tianhua Gu

(57) ABSTRACT

The present invention relates to Trash field. More particularly, the present invention relates to Trash can lid. The present invention provides a design of a big lid and a small lid. When an inhabitant usually disposes trash, he or she need only press a button to open the small lid. Since the small lid is connected with the big lid by magnetism and a spring buffer unit is installed in the seat of small lid, opening the small lid is very smooth, without any noise or vibration. When a dustman collects the trash, what he needs to do is only to open the big lid, being very convenient and sanitary.

4 Claims, 5 Drawing Sheets

III

TRASH CAN LID

CROSS REFERENCE TO THE RELATED PATENT APPLICATIONS

This patent application claims the priority of the Chinese patent application No. 200920291683.5 filed on Dec. 10, 2009, which application is incorporated herein by reference.

BACKGROUND OF THE INVENTION

1. Field of the Invention

The present invention relates to Trash. More particularly, the present invention relates to Trash can lid.

2. Related Prior Art

With the improvement of people's life quality, trash has increased gradually and the trash can is used more and more commonly. To satisfy different cases, current trash can produced by most manufactures has only one lid. The shortcoming of such common design is when an inhabitant opens the lid of trash can to dispose trash; he or she will face all the ungraceful and dirty trash exposed to him or her.

SUMMARY OF THE INVENTION

In order to solve the shortcoming of the prior art, the present invention provides a trash can with two lids. The present invention provides a design of a big lid and a small lid. When an inhabitant usually disposes trash, he or she need only press a button to open the small lid. Since the small lid is connected with the big lid by magnetism and a spring buffer unit is installed in the seat of small lid, opening the small lid is very smooth, without any noise or vibration.

A Trash can lid comprising:

A base (1), a big lid (2) and a small lid (3); a left side of the base (1) is pin-jointed with a left side of the big lid (2), a button switch is provided between right sides of both the base (1) and the big lid (2), when the button switch is pressed, the big lid (2) can be flipped around the left side of the base (1); the left side of big lid (2) is pin-jointed with a left side of the small lid (3), a button switch is provided between right sides of both the big lid (2) and the small lid (3), press the button switch to flip the small lid (3) around the left side of big lid (2).

The left side of base (1) is provided with an axle hole (11) and the left side of big lid (2) is provided with an axle hole (21), a rotatable axle (24) inserts in both axle holes (11, 21) and the big lid (2) can be flipped around the rotatable axle (24).

The big lid (2) is provided with an opening (22), the small lid (3) is provided with a rotary member (32), the rotary member (32) is coupled with the small lid (3) by a U-shape curved section (33) and is provided with an axle hole (34), the rotary member (32) extends in the opening (22), a separating plate (323) is provided in the center of axle hole (34) and two cylinders (321, 322) are provided at both sides of the separating plate (323), springs (41, 42) sheathe the cylinders (321, 322), the cylinders (321, 322) are designed to protect spring (41, 42) from dislocating, rotor shafts (52, 51) are provided at the outside of spring (41, 42) and pin holes (521, 511) are provided in the rotor shaft (52, 51) Pins (62, 61) are provided inside pin holes (521, 511) and fix the rotor shafts (52, 51) at the left side of big lid (2).

The button switch provided between the right sides of big lid (2) and small lid (3) is as follows: a button (28) is provided in the big lid (2), a spring (27) and a button connector (26) are below the button (28), a magnet (29) is provided in the button connector (26), a iron piece (39) is provided in the small lid (3) over the magnet (29). The button switch provided between the right sides of base (1) and big lid (2) is as follows: a button (18) is provided on the right side of base (1), a spring (17) is provided between the button (18) and the base (1), a barb (23) is provided in big lid (2), a locked groove (181) is provided on the button (18) to match the barb (23).

To mount the small lid (3), gently press the rotor shaft (52, 51) in the axle hole (34) of rotary member (32), then place the rotary member (32) of small lid (3) into the opening (22). Then the spring (42, 41) in rotary member (32) will eject the rotor shaft (52, 51) outwards so that the rotor shaft (52, 51) will get stuck in the opening (22).

When the button (28) is pressed, the button connector (26) will move downwards so that the distance between the magnet (29) in the button connector (26) and the iron piece (39) provided in the small lid (3) will be increased, while the magnet will be decreased to allow the small lid (3) to be opened.

When being pressed, the button (18) will move leftwards and the locked groove (181) on the button (18) will move leftwards too. At this time, the barb (23) disengages the restriction of the locked groove (181) so as to open the big lid (2). When being released, the button (18) will be bounced to its original state by the spring (17).

DESCRIPTION OF THE PREFERRED EMBODIMENTS

Figure 1:
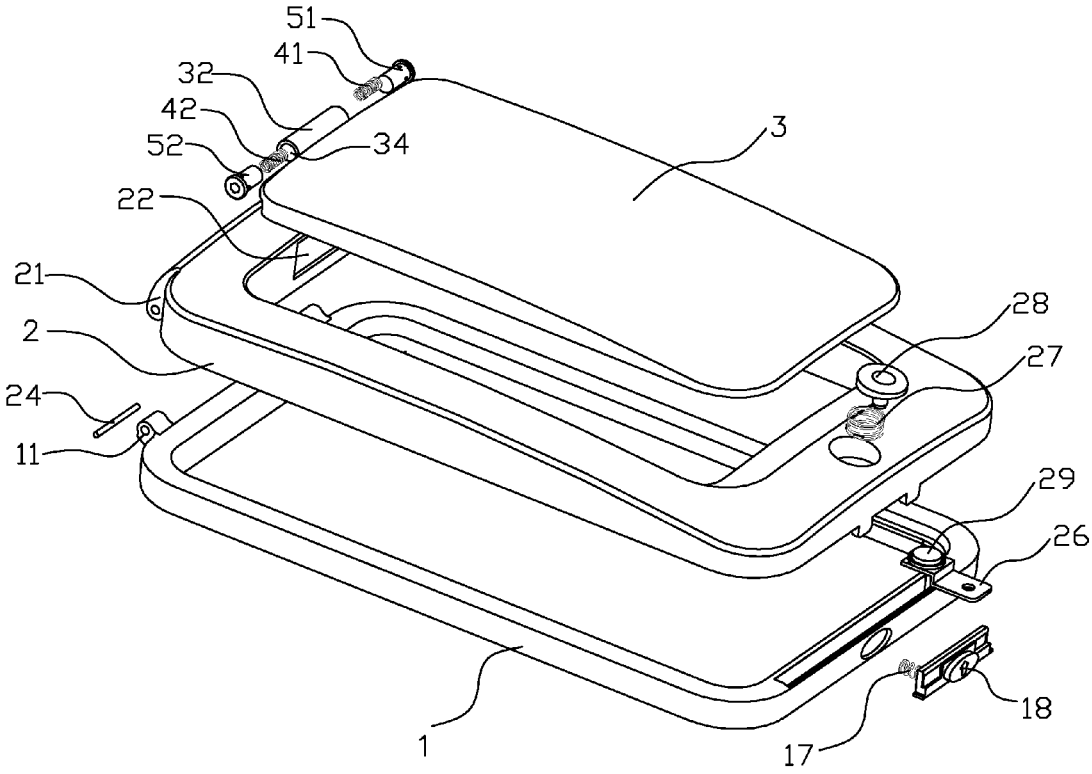
FIG. 1 is a 3D view of embodiment 1 of the present invention.
Figure 2:
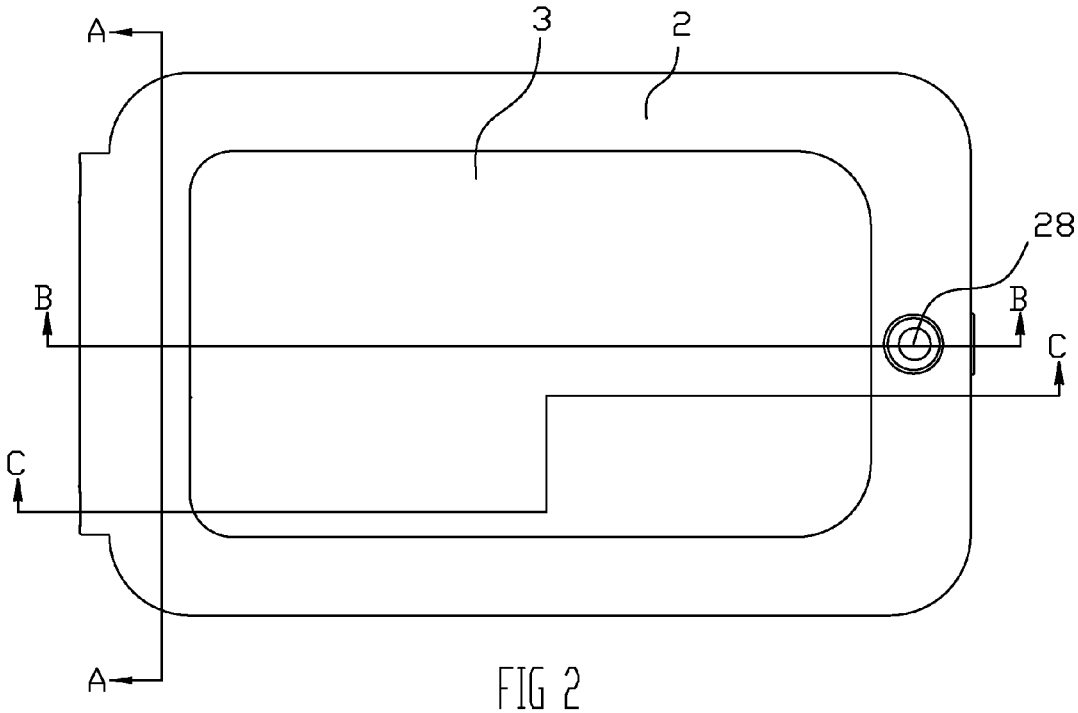
FIG. 2 is a vertical view of FIG. 1.
Figure 3:
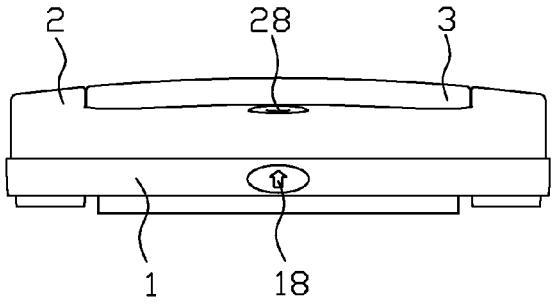
FIG. 3 is a right view of FIG. 1.
Figure 4:
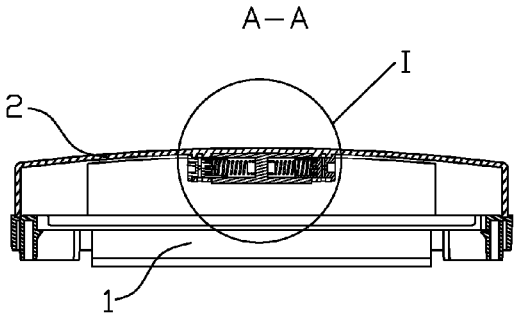
FIG. 4 is a sectional view of FIG. 2 along A-A line.
Figure 5:
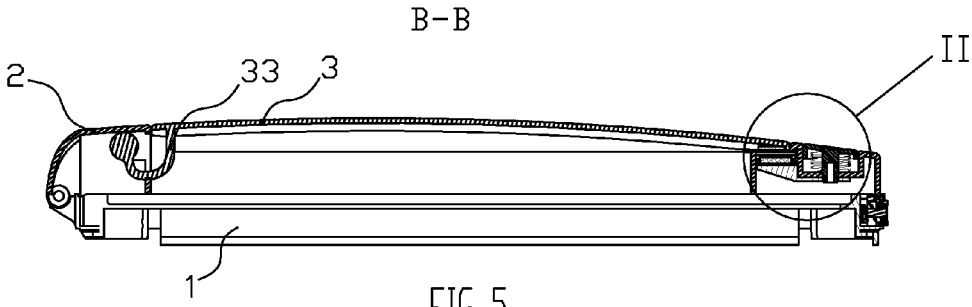
FIG. 5 is a sectional view of FIG. 2 along B-B line.

The preferred embodiment of the present invention will now be described with reference to FIGS. 1-9 of the drawings. Identical elements in the various figures are identified with the same reference numerals.

A Trash can lid, as shown in FIG. 1 to FIG. 6, comprising:

A base (1), a big lid (2) and a small lid (3);

a left side of the base (1) is pin-jointed with a left side of the big lid (2), a button switch is provided between right sides of both the base (1) and the big lid (2), when the button switch is pressed, the big lid (2) can be flipped around the left side of the base (1); the left side of big lid (2) is pin-jointed with a left side of the small lid (3), a button switch is provided between right sides of both the big lid (2) and the small lid (3), press the button switch to flip the small lid (3) around the left side of big lid (2).

The left side of base (1) is provided with an axle hole (11) and the left side of big lid (2) is provided with an axle hole (21), a rotatable axle (24) inserts in both axle holes (11, 21) and the big lid (2) can be flipped around the rotatable axle (24).

The big lid (2) is provided with an opening (22), the small lid (3) is provided with a rotary member (32), the rotary member (32) is coupled with the small lid (3) by a U-shape curved section (33) and is provided with an axle hole (34), the rotary member (32) extends in the opening (22), a separating plate (323) is provided in the center of axle hole (34) and two cylinders (321, 322) are provided at both sides of the separating plate (323), springs (41, 42) sheathe the cylinders (321, 322), the cylinders (321, 322) are designed to protect spring (41, 42) from dislocating, rotor shafts (52, 51) are provided at the outside of spring (41, 42) and pin holes (521, 511) are provided in the rotor shaft (52, 51) Pins (62, 61) are provided inside pin holes (521, 511) and fix the rotor shafts (52, 51) at the left side of big lid (2).

The button switch provided between the right sides of big lid (2) and small lid (3) is as follows: a button (28) is provided in the big lid (2), a spring (27) and a button connector (26) are below the button (28), a magnet (29) is provided in the button connector (26), a iron piece (39) is provided in the small lid (3) over the magnet (29). The button switch provided between the right sides of base (1) and big lid (2) is as follows: a button (18) is provided on the right side of base (1), a spring (17) is provided between the button (18) and the base (1), a barb (23) is provided in big lid (2), a locked groove (181) is provided on the button (18) to match the barb (23).

Figure 6:
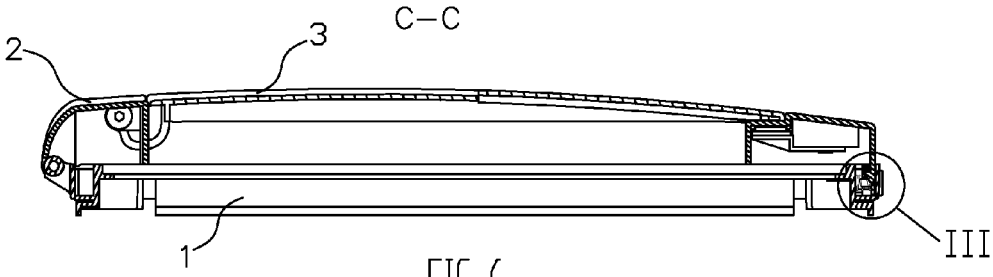
FIG. 6 is a sectional view of FIG. 2 along C-C line.

As shown in FIG. 6, to mount the small lid (3), gently press the rotor shaft (52, 51) in the axle hole (34) of rotary member (32), then place the rotary member (32) of small lid (3) into the opening (22). Then the spring (42, 41) in rotary member (32) will eject the rotor shaft (52, 51) outwards so that the rotor shaft (52, 51) will get stuck in the opening (22).

Figure 7:
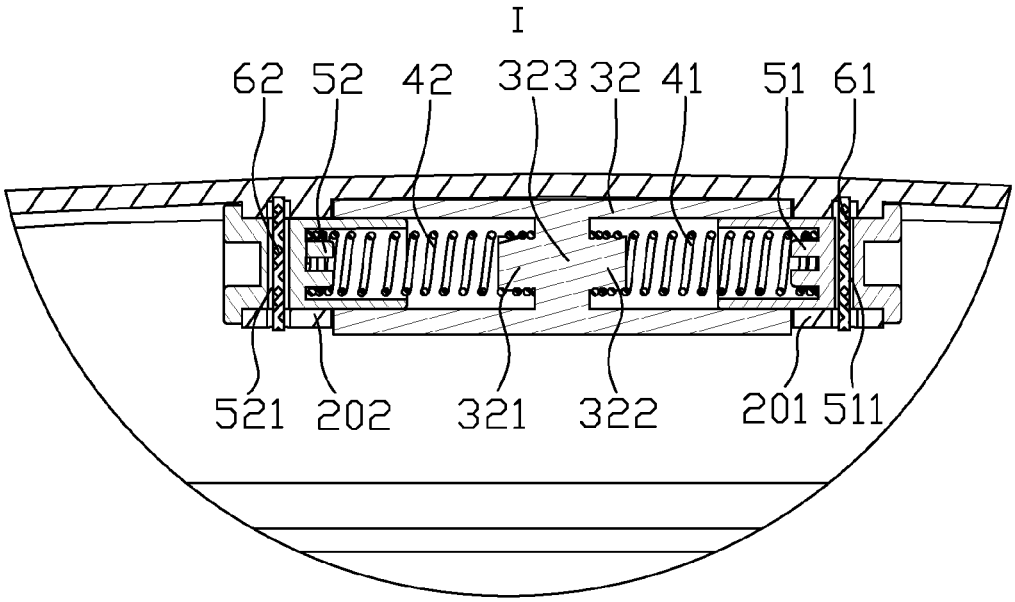
FIG. 7 is an enlarged view of Part I of FIG. 4.

As shown in FIG. 7, when the button (28) is pressed, the button connector (26) will move downwards so that the distance between the magnet (29) in the button connector (26) and the iron piece (39) provided in the small lid (3) will be increased, while the magnet will be decreased to allow the small lid (3) to be opened.

Figure 8:
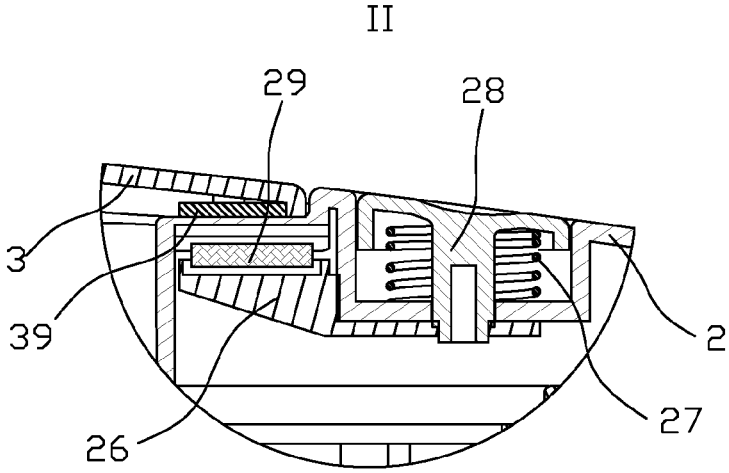
FIG. 8 is an enlarged view of Part II of FIG. 5.
Figure 9:
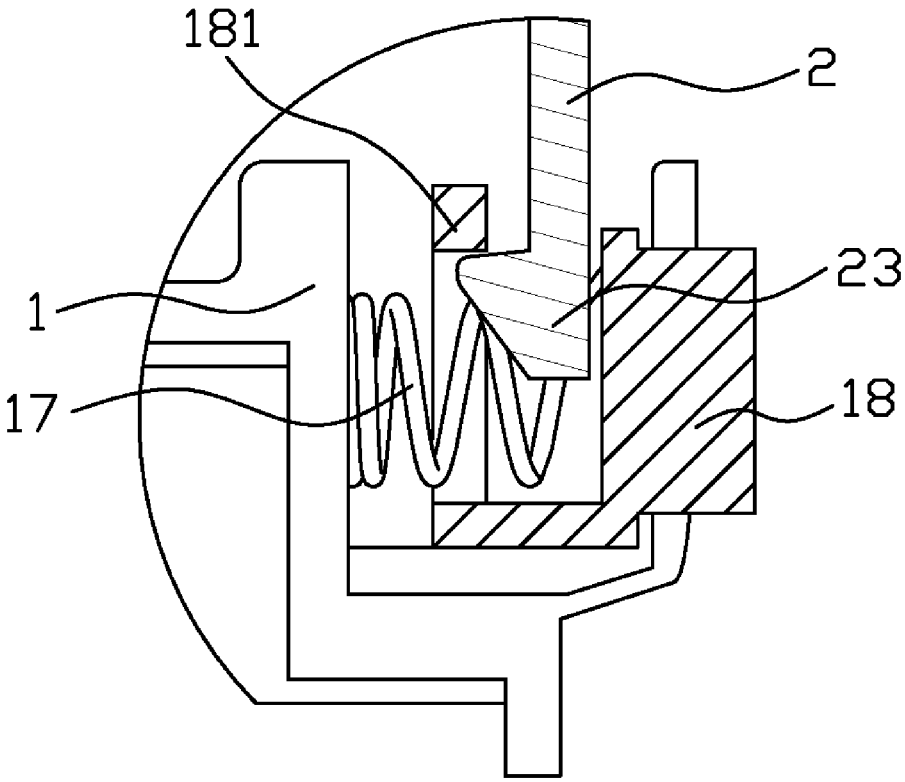
FIG. 9 is an enlarged view of Part III of FIG. 6.

As shown in FIG. 8, when being pressed, the button (18) will move leftwards and the locked groove (181) on the button (18) will move leftwards too. At this time, the barb (23) disengages the restriction of the locked groove (181) so as to open the big lid (2). When being released, the button (18) will be bounced to its original state by the spring (17).

The present invention provides a convenient design of a big lid and a small lid. When an inhabitant usually disposes trash, he or she need only open the small lid. When a dustman collects the trash in the trash can, what he needs to do is only to open the big lid, being very convenient and sanitary.

What is claimed is:

1. A trash can lid comprising:

a base (1), a big lid (2) and a small lid (3);

a left side of the base (1) is pin-jointed with a left side of the big lid (2), a button switch is provided between right sides of both the base (1) and the big lid (2), when the button switch is pressed, the big lid (2) can be flipped around the left side of the base (1);

the left side of big lid (2) is pin-jointed with a left side of the small lid (3), a button switch is provided between right sides of both the big lid (2) and the small lid (3), when the button switch is pressed, the small lid (3) can be flipped around the left side of big lid (2);

the big lid (2) is provided with an opening (22), the small lid (3) is provided with a rotary member (32), the rotary member (32) is coupled with the small lid (3) by a U-shape curved section (33) and is provided with an axle hole (34), the rotary member (32) extends in the opening (22), a separating plate (323) is provided in the center of axle hole (34) and two cylinders (321, 322) are provided at both sides of the separating plate (323), springs (41, 42) sheathe the cylinders (321, 322), the cylinders (321, 322) are designed to protect springs (41, 42) from dislocating, rotor shafts (52, 51) are provided at the outside of springs (41, 42) and pin holes (521, 511) are provided in the rotor shafts (52, 51), pins (62, 61) are provided inside pin holes (521, 511) and fix the rotor shafts (52, 51) at the left side of big lid (2).

2. The trash can lid of claim 1, wherein the left side of base (1) is provided with an axle hole (11) and the left side of big lid (2) is provided with an axle hole (21), a rotatable axle (24) inserts in both axle holes (11, 21) and the big lid (2) can be flipped around the rotatable axle (24).

3. The trash can lid of claim 1, wherein the button switch provided between the right sides of big lid (2) and small lid (3) including a button (28) is provided in the big lid (2), a spring (27) and a button connector (26) are below the button (28),a magnet (29) is provided in the button connector (26), a iron piece (39) is provided in the small lid (3) over the magnet (29).

4. The trash can lid of claim 1, wherein the button switch provided between the right sides of base (1) and big lid (2) including a button (18) is provided on the right side of base (1), a spring (17) is provided between the button (18) and the base (1), a barb (23) is provided in big lid (2), a locked groove (181) is provided on the button (18) to match the barb (23).

* * * * *